United States Patent [19]

Soraya et al.

[11] 4,408,986

[45] Oct. 11, 1983

[54] METHOD FOR THERMAL TREATMENT OF WIRE LASHINGS AND A CONTINUOUS-HEATING FURNACE FOR PERFORMANCE OF THE METHOD

[75] Inventors: Sorayapour Soraya, Saarlouis; Gundolf Feld, Püttlingen-Köllerbach; Fredy Wacker, Wadgassen-Differten, all of Fed. Rep. of Germany

[73] Assignee: Stahlwerke Rochling-Burbach GmbH, Volklingen, Fed. Rep. of Germany

[21] Appl. No.: 301,537

[22] Filed: Sep. 14, 1981

[30] Foreign Application Priority Data

Sep. 17, 1980 [DE] Fed. Rep. of Germany ..... 3035032

[51] Int. Cl.[3] ..... F21C 9/00; F27D 3/00; F27D 7/04; C21D 9/52

[52] U.S. Cl. ..... 432/6; 266/102; 432/9; 432/59; 432/199

[58] Field of Search ..... 432/6, 8, 9, 59, 199, 432/203, 205; 266/102; 148/31

[56] References Cited

U.S. PATENT DOCUMENTS 2,875,997 3/1959 Blackman ..... 432/6

FOREIGN PATENT DOCUMENTS 3035032 8/1982 Fed. Rep. of Germany .
515339 12/1939 United Kingdom .
755237 8/1956 United Kingdom ..... 432/199
962289 7/1964 United Kingdom .
1231246 5/1971 United Kingdom .
1393440 5/1972 United Kingdom .
1325018 8/1973 United Kingdom .
1419308 12/1975 United Kingdom .

*Primary Examiner*—John J. Camby
*Attorney, Agent, or Firm*—Toren, McGeady and Stanger

[57] ABSTRACT

A method for thermal treatment of horizontal wire rings with convective heat transfer by means of circulated furnace gases, characterized in that said wire rings, particularly for thermal treatment above temperatures of 650° C. are acted upon in the resting state from two sides, from the top and the bottom, with a directed flow of furnace gases in order to generate a turbulent flow condition in the center of said ring. As a result of this method, it is proper to connect wire rings for uniform thermal treatment. An apparatus for carrying out the treatment is also disclosed.

6 Claims, 2 Drawing Figures

METHOD FOR THERMAL TREATMENT OF WIRE LASHINGS AND A CONTINUOUS-HEATING FURNACE FOR PERFORMANCE OF THE METHOD

BACKGROUND OF THE INVENTION

1. Field of the Invention

The method relates to convective heat transfer in wire lashings of steel and non-ferrous metal and has the goal to realize the heat and flow conditions for rapid and uniform heating and cooling in a continuous-heating furnace of wire rings which are stacked to form a lashing. This task is solved according to the invention essentially in that the stacks of wire lashings are placed in cycle with the furnace charge of a roller bottom furnace always between two upper and lower pressure openings in a strong circulation of furnace gas of the respective blow-in stations and thus the furnace gases with their high proportion of kinetic energy of flow impinge upon one another in the central hollow space of the stack and consequently the flow is retained while the static pressure is increased and flows out from there uniformly and turbulently through the windings of the lashings, due to the conversion of potential energy to kinetic energy.

2. Description of the Prior Art

In many respects it is an important goal to subject wire rings uniformly to thermal treatment. Not only is heating energy to be saved, but it is also to be accomplished that a primary material is made available for further processing which is uniform in its metallurgical and mechanical properties. The present state of the art has not yet made it possible that all parts of a wire ring are subjected during thermal treatment to the greatest extent to the same conditions of heat transfer. Particularly the fact plays an important part that the process of heating and cooling which is very time-dependent is exactly that stage within the scope of thermal treatment during which making the heat transfer uniform is the decisive measure. Taking the wire ring geometry into consideration, it is clear that the participation of heat conduction and radiation of heat in heating a wire ring is strongly reduced as compared to the convection effect. This makes it clear that an improvement of the thermal treatment of wire rings can only be achieved by means of that method according to which the convection of the furnace gases in the heating zone of a roller bottom furnace is made uniform and is simultaneously increased for all parts of a stack of wire lashings.

SUMMARY OF THE INVENTION

According to the invention, this is achieved in that the central hollow space of the stack of wire lashings is pneumatically formed and maintained as a damming space for the furnace gases and it is thus prevented that disadvantaged areas result in the stack as long as the dynamic pressure is sufficient to maintain the necessary turbulent flow condition in the region of the stack and its immediate proximity.

It is also provided according to the invention that the intensive, preferably convective, heat transfer during heating and cooling of the wire lashings takes place in steps, but within a continuous passage. The conventional continuous-heating furnace receives for this purpose a special inlet section and end section which will still be described. Following the inlet section, after all areas of the wire lashing have reached the desired temperature, it is only necessary to compensate for the heat losses of the furnace and to guarantee the stability of the inside temperature of the furnace. Here the type of heating according to the invention will no longer be absolutely necessary. In the holding duration section of the furnace it is sufficient to maintain a heat transfer system, which, for instance, works preferably with radiation, when the desired temperature lies higher than approximately 650° C. Otherwise an external convection around the wire lashing will be sufficient in order to maintain the temperature uniformity which has already been reached at the end of the heating section.

DESCRIPTION OF THE PREFERRED EMBODIMENT

Figure 1:
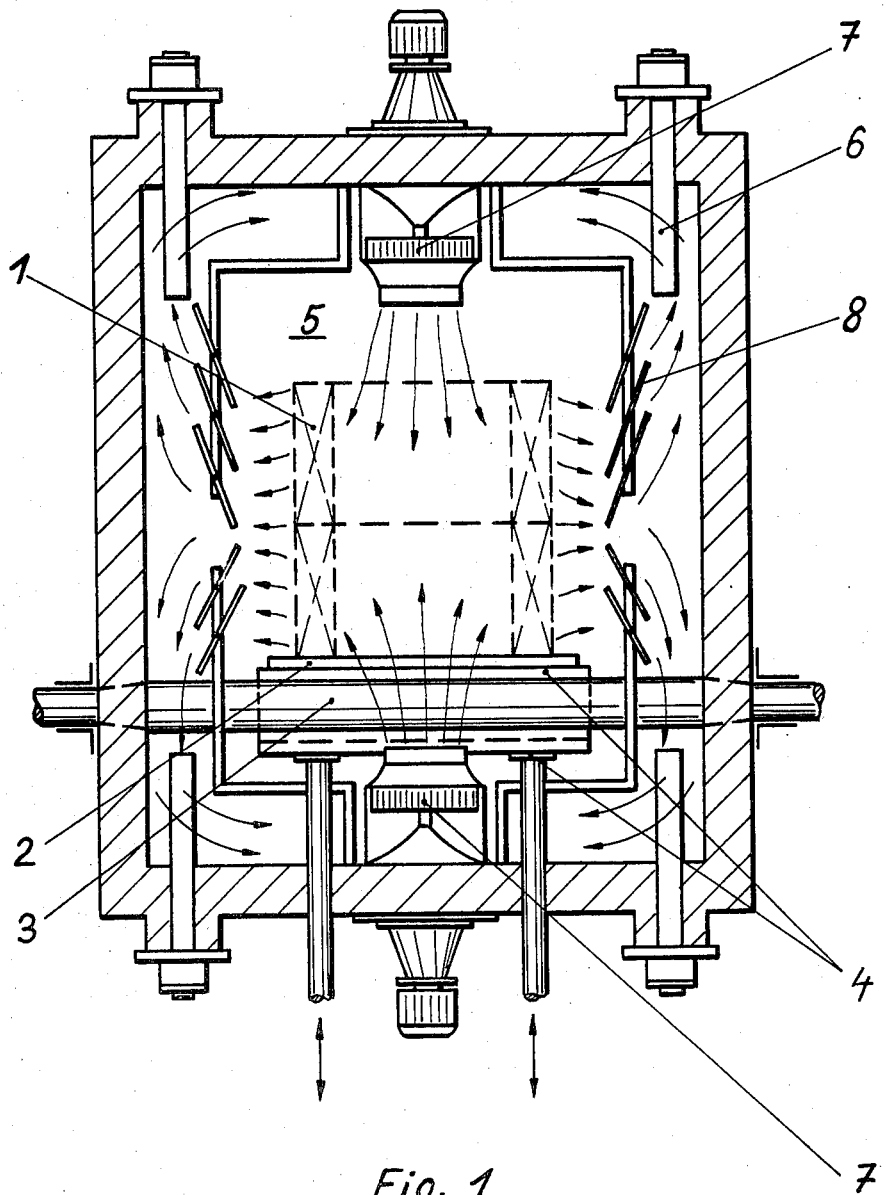
FIG. 1 shows a heating or cooling zone of the roller bottom furnace according to the invention in cross-section.

Methods and furnace units for uniform thermal treatment of wire lashings have been suggested and built several times. It is known from the German Auslegeschrift No. 1,940,376 to conduct furnace gases essentially radially, directly forced through the wire lashings. But here the central hollow space of the wire lashings is closed at the top by a placed-on cover which leads to a disadvantageous heat transfer to the wire windings which lie directly below the cover or which otherwise requires a very complicated adaptation to the cover shape of the laminar gas flow which primarily exists here. The furnace gas flow which is established according to the mentioned Auslegeschrift with at least 500 $Nm^3$ gas per hour and per ton of wire may lead to a primarily laminar flow with the result that the pressure loss of the flow remains small, however also the heat transfer from the furnace gas to the wire windings is limited and does not take place uniformly due to the strong local differences in flow resistance which exist in the wire ring.

By comparison, in the method according to the invention we needed about 12 times the gas flow, i.e. at least 6000 $Nm^3$ of gas per hour and per ton of wire, in order to build up a sufficient dynamic pressure in the hollow space of the stack of wire lashings to produce and maintain a turbulent flow. The herewith attainable average Re coefficient of turbulence can be determined at 8800 for a wire diameter of 20 mm. The heating method according to the invention makes possible an average effective heat transfer coefficient of 50 up to approximately 120 $W/m^2$ K depending on the furnace gas flow which is provided with at least 6000 $Nm^3$ per hour and per ton of wire. With the heat transfer coefficient 50 $W/m^2$ K, a heating time of 40 minutes for a wire ring of steel with a wire diameter of 20 mm can be determined. Tests during cooling of the wire rings confirm the calculated results, wherein, for instance, a volume flow of 10,000 $Nm^3$ per hour and per ton of wire could produce a turbulent flow condition.

The German AS No. 1,959,712 describes basically a thermal treatment in which the stack of wire lashings is also closed at the top with a cover and a flow of at least 500 $Nm^3$ of gas per hour and per ton of wire flows through from the bottom. This method also has the disadvantage that preferred and disadvantaged areas result in the material to be heat-treated, particularly in the region of the cover and the palette grate.

According to the German OS No. 28 30 153, another method is known wherein partial processes during quenching and during tempering of wire or bands coiled to form rings, the rings are subjected to oncoming flow at the end face from both sides with quenching medium or furnace gases. However, this relates to wire rings which have a horizontal turn axis and which are treated while hanging on hooks. This method has only limited use, for instance, during heating to austenitizing temperatures of 840° C. and above. But already at very high tempering temperatures exceeding 650° C. and wire diameters which are smaller than approximately 10 mm, deformations of the hanging wire windings may occur so that it is no longer possible to work with a simple hook shape in the tempering furnace. Softannealing of hanging wire rings, for instance of cold upsetting qualities, causes problems for the same reason because the temperatures necessary exceed 700° C. In addition, it must be emphasized again in this connection that a forced flow of the furnace gases through the windings of a wire ring is only necessary and useful as long as the wire ring is in the dynamic heating process or cooling process. During the holding period at the desired temperature it is sufficient to guarantee merely an insulating action of the furnace zone. During heating it is usually sufficient when the method according to the invention is applied only up to the temperature range of approximately 650° to 700° C. in order to still be able to industrially realize convection flows of up to 50,000 cubic meters per hour of operation and per blower. This is because continued heating up to a rated temperature above 800° C. does no longer control convection due to the strong increase of radiation inside the wire rings.

Figure 2:
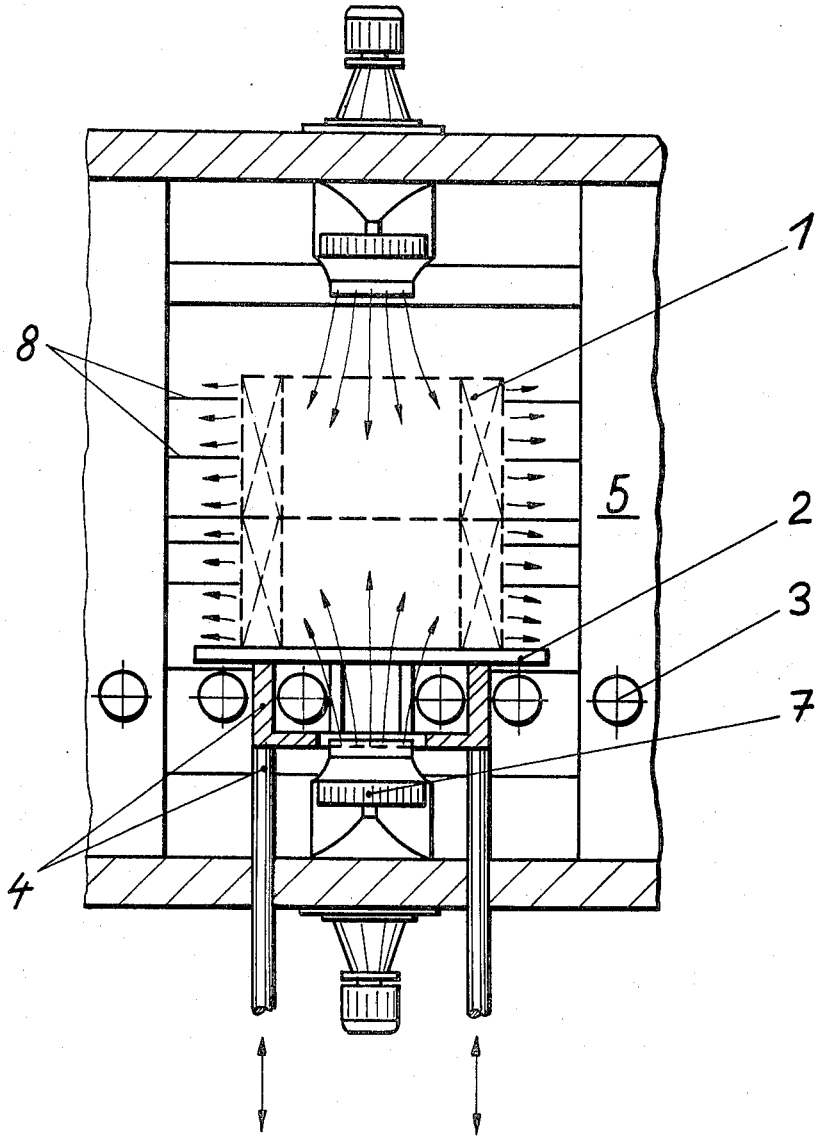
FIG. 2 shows a heating or cooling zone of the furnace in longitudinal section.

The deliberations made in the invention lead to the construction of a special type of industrial furnace which may be called an expanded roller bottom furnace. A roller bottom furnace which is equipped according to the invention is shown in FIGS. 1 and 2.

The stacks 1 of wire lashings are penetrated in the continuously operating, conventional roller bottom furnaces by palette grates 2 with a roller table 3. The gas permeable palette grates 2 which are open in the center are according to the invention positioned at the individual blow-on stations by stopping the roller table 3 for a short period and are lifted from the roller table by raising a lifting table 4. Then the roller table 3 is again put in operation in order to prevent distortion of the individual rollers.

Gas burners 6 of the conventional type or radiation tubes which are not shown in the figures project into the furnace space 5. The hot furnace gases which were heated at the gas burners 6 are sucked in by two vertically opposite blowers 7 and are blown with directed flow on both sides into the stack 1 of wire lashings. Consequently, a uniform pressure builds up in the hollow space of the stack 1 of wire lashings. The thus resulting dam space effects that the furnace gases flow out, in the manner which was already described, turbulently and uniformly over the entire height of the stack of wire lashings through the individual wire windings.

The furnace gases which primarily return from the stack of wire lashings are drawn in through openings, flaps or shutters which can be adjusted in the cross-section and are arranged in the protective wall 8. The adjustment of the flow passage cross-section of the protective wall makes it possible to control the circulation depending on the furnace schedule of the materials to be heat-treated.

After a holding time which corresponds to the cycle of the furnace charge the roller table 3 is again temporarily stopped, the palette grate 2 with the stack 1 of wire lashings is placed by means of the lifting table 4 onto the roller table 3 and the palette grate with the stack of wire lashings located thereon is moved to the next blow-on station.

In order to prevent the mutual, disadvantageous effect on the flow of the stacks which are held in the heating section, the distances between palettes in the heating section may be larger than those in the temperature holding section. The method of operation then is such that the speed of the roller table becomes greater in the heating section, corresponding to the increase in spacing, than the speed in the temperature holding section of the furnace.

In FIG. 2 it is evident that the directed oncoming flow can also be made possible through the roller table in that the center distance of the rollers in the region of the pressure opening of the bottom blower is increased without impairing the movement of the palette grates during passage through the furnace.

We claim:

1. In a method for the thermal treatment of horizontal wire rings wherein the rings are stacked one upon the other in a convection oven and hot gases are circulated around the rings, the improvement which comprises operating said oven at a temperature above 650° C., said stacked rings being in the resting state, and blowing the furnace gases simultaneously from points directly above and directly below the stack towards and into the center of the stack whereby flows are formed which impinge upon one another at the center and generate a turbulent flow condition in the center of the stack.

2. The method of claim 1, wherein gas flows are at least 6000 $Nm^3$ per hour and per ton of steel.

3. The method of claim 1 or 2 wherein the two flows are generated by placing a first circulation blower vertically at the top of the stack and a second circulation blower vertically at the bottom of the stack.

4. The method of claim 3 which further comprises passing the furnace gases, which were directed into the center of the stack and which escape from the center through spaces between the rings, through flow control means located in the inner walls of the furnace, and then passing the gases over heating means to raise the temperature of the gases to the desired temperature and then returning the heated gases to the blowers.

5. In a furnace for the thermal treatment of horizontal wire rings having means in the lower portion for stacking the rings one upon the other and means for circulating hot gases around the rings, the improvement which comprises said stacking means being gas permeable palette grates (2) having an opening in the center on which the stack may be placed, blowing means positioned in the furnace so as to be arranged above and below a stack for blowing the gas into the center of the stack so as to cause flows which impinge upon one another and generate turbulence within the center of the stack, a roller table (3) located in the lower portion of the furnace for moving the stack into and out of the furnace and a lifting table (4) located below the palette grates (2) for lifting a stack which is in the oven resting on the palette grates into a centrally located position between said blowing means.

6. The furnace of claim 5, wherein the distance between the rollers of the roller table 3 is increased in the region of said blowing means.

* * * * *